US010375767B2

(12) United States Patent
Kazemi et al.

(10) Patent No.: US 10,375,767 B2
(45) Date of Patent: Aug. 6, 2019

(54) HEATER CABLE HAVING A TAPERED PROFILE

(71) Applicant: Pentair Thermal Management LLC, Menlo Park, CA (US)

(72) Inventors: Mohammad Kazemi, San Jose, CA (US); Linda D. B. Kiss, San Mateo, CA (US); Sirarpi Jenkins, Menlo Park, CA (US)

(73) Assignee: nVent Services GmbH, Schaffhausen (CH)

( * ) Notice: Subject to any disclaimer, the term of this patent is extended or adjusted under 35 U.S.C. 154(b) by 782 days.

(21) Appl. No.: 15/019,834

(22) Filed: Feb. 9, 2016

(65) Prior Publication Data

US 2016/0234884 A1 Aug. 11, 2016

Related U.S. Application Data

(60) Provisional application No. 62/113,994, filed on Feb. 9, 2015.

(51) Int. Cl.
*H05B 3/56* (2006.01)
*H05B 3/04* (2006.01)

(52) U.S. Cl.
CPC ..... *H05B 3/56* (2013.01); *H05B 3/04* (2013.01); *H05B 3/565* (2013.01); *H05B 2203/011* (2013.01); *H05B 2203/02* (2013.01)

(58) Field of Classification Search
CPC . H05B 3/56; H05B 3/04; H05B 3/565; H05B 2203/011; H05B 2203/02;
(Continued)

(56) References Cited

U.S. PATENT DOCUMENTS 341,690 A 5/1886 Reichenbach
4,200,973 A 5/1980 Farkas
(Continued)

FOREIGN PATENT DOCUMENTS

CA 1334335 C 4/2016
EP 0338552 B1 11/1994
(Continued)

OTHER PUBLICATIONS

International Search Report and Written Opinion from the International Searching Authority for PCT/US 16/17193; dated May 13, 2016; 21 pages.

*Primary Examiner* — David J Walczak
(74) *Attorney, Agent, or Firm* — Quarles & Brady LLP

(57) ABSTRACT

A self-regulating heater cable includes a PTC core formed of positive temperature coefficient material and disposed in electrical contact with at least two bus wires. The PTC core may encapsulate the bus wires and space the bus wires apart a predetermined distance via a connecting portion of the PTC core. The connecting portion has a tapered profile, and is thinner at the ends approximate the bus wires and thicker in a portion between the ends, which portion may be toward or at the center of the connecting portion. The thicknesses of the ends and the thicker portion are selected to produce a ratio that is within a range at which the heater cable produces heat at its outer surface with a substantially uniform profile, and primary heat generation of the heater cable has not shifted from the center of the connecting portion to the ends of the connecting portion.

17 Claims, 6 Drawing Sheets

(58) Field of Classification Search
CPC ..... H05B 2203/016; H05B 3/10; H05B 3/12; H05B 3/18; E21B 36/04
See application file for complete search history.

(56) References Cited

U.S. PATENT DOCUMENTS

| | | | | | |
|---|---|---|---|---|---|
| 4,242,573 | A | * | 12/1980 | Batliwalla | A47C 21/048 219/504 |
| 4,307,290 | A | * | 12/1981 | Bloore | H05B 3/56 219/528 |
| 4,314,145 | A | * | 2/1982 | Horsma | H01C 7/027 174/110 PM |
| 4,334,148 | A | | 6/1982 | Kampe | |
| 4,560,524 | A | | 12/1985 | Smuckler | |
| 4,650,972 | A | | 3/1987 | Cunningham | |
| 4,668,857 | A | | 5/1987 | Smuckler | |
| 4,724,417 | A | | 2/1988 | Au et al. | |
| 4,857,880 | A | | 8/1989 | Au et al. | |
| 5,767,448 | A | | 6/1998 | Dong | |
| 5,782,301 | A | | 7/1998 | Neuroth et al. | |
| 6,111,234 | A | | 8/2000 | Batliwalla et al. | |
| 6,762,395 | B2 | | 7/2004 | Yagnik et al. | |
| 7,566,849 | B2 | | 7/2009 | O'Connor | |
| 8,525,084 | B2 | | 9/2013 | O'Connor | |
| 2005/0252910 | A1 | | 11/2005 | O'Connor | |
| 2007/0095818 | A1 | | 5/2007 | O'Connor | |
| 2010/0059502 | A1 | | 3/2010 | O'Connor | |
| 2014/0238968 | A1 | | 8/2014 | Lee | |

FOREIGN PATENT DOCUMENTS

| | | | |
|---|---|---|---|
| EP | 0880302 | B1 | 9/2005 |
| EP | 1123344 | B1 | 6/2006 |
| EP | 2113927 | A1 | 11/2009 |
| GB | 2195840 | A | 4/1988 |

* cited by examiner

HEATER CABLE HAVING A TAPERED PROFILE

CROSS-REFERENCE TO RELATED APPLICATIONS

This application is a non-provisional claiming the benefit of U.S. Prov. Pat. App. Ser. No. 62/113,994, having the same title, filed Feb. 9, 2015, and incorporated fully herein by reference.

FIELD OF THE INVENTION

The present invention generally relates to heater cables, and more specifically to self-regulating heater cables.

BACKGROUND OF THE INVENTION

Heater cables, such as self-regulating heater cables, tracing tapes, and other types, are cables configured to provide heat in applications requiring such heat. Heater cables offer the benefit of being field-configurable. By this, heater cables may be applied or installed as needed without the requirement that application-specific heating assemblies be custom-designed and manufactured, though heater cables may be specifically designed for application-specific uses in some instances.

In some approaches, a heater cable operates by use of a pair or more of bus wires having a high conductance coefficient (i.e., low resistance). The bus wires are coupled to differing voltage supply levels to create a voltage potential between them. A positive temperature coefficient (PTC) material is often situated between the bus wires and current is allowed to flow through the PTC material, thereby generating heat. As the temperature increases, so does the resistance of the PTC material, thereby reducing the current therethrough and the heat generated. The heater cable is thus self-regulating in terms of the amount of thermal energy (i.e., heat) output by the cable.

Certain configurations of previous heater cables may suffer high temperature gradients throughout the cable. Such gradients can occur lengthwise along the length of the cable or can occur across a cross-section of the cable. These high temperature gradients may be caused by small high-active heating volumes (e.g., PTC material) within the heater cable that can create localized heat as opposed to heat spread over a larger surface area or volume. In some instances, these localized high-active heating volumes can cause non-uniform heat output along the length or across the width of the cable. Furthermore, the localization of increased thermal output may generate heat of a temperature that can reduce the lifespan of the heater cable or can thermally age some portions of the heater cable quicker than others. A heater cable that reduces temperature gradients may be desirable in some instances.

DETAILED DESCRIPTION

The present invention overcomes the aforementioned drawbacks by providing in various embodiments a heater cable having a minimized operational temperature gradient. The minimized temperature gradient results in improved thermal equalization, thereby reducing maximum temperature generated at localized points of the heater cable and improving the lifespan of the heater cable. Additionally, heat is provided along the external surface of the cable in a more uniform manner with a reduced gradient along a cross-sectional edge of the cable, thereby resulting in more usable surface area for contacting a surface to be heated.

Figure 1:
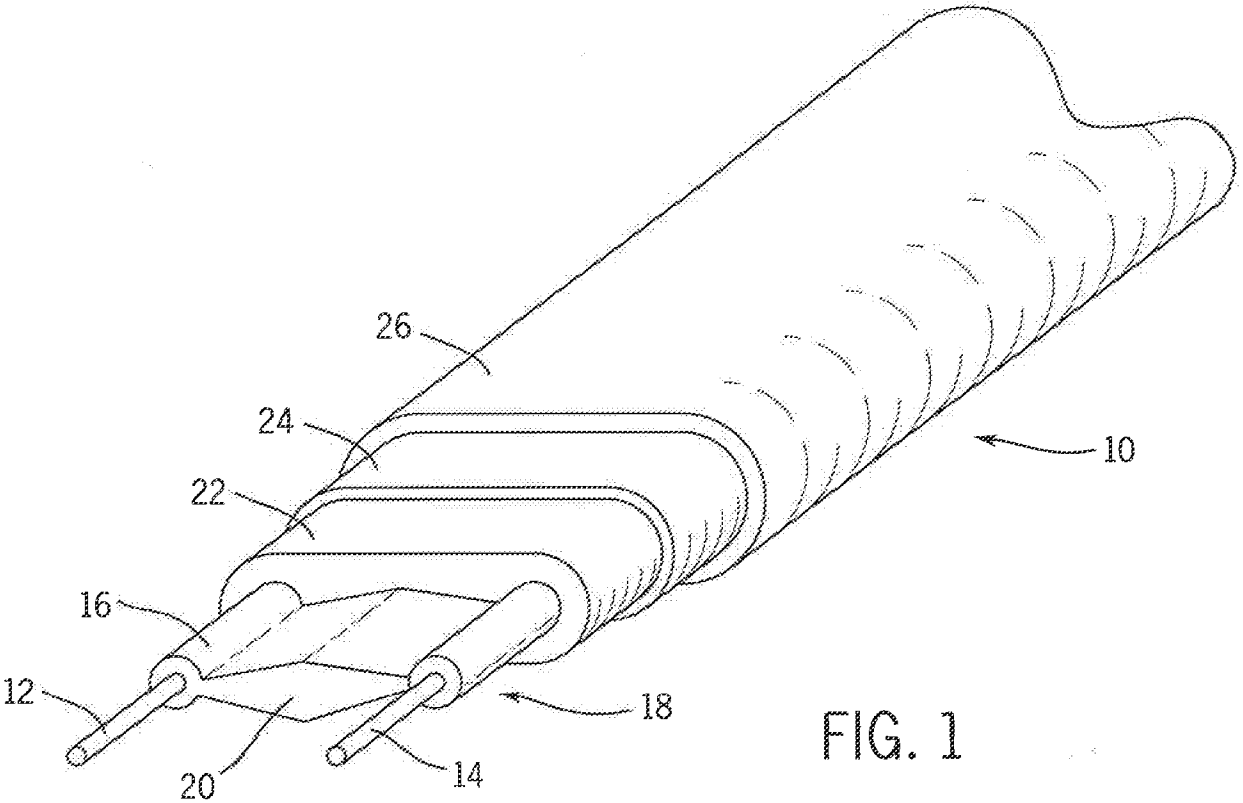
FIG. 1 is a perspective view of a heater cable in accordance with various embodiments of the present disclosure.

Referring now to the figures, FIG. 1 illustrates a heater cable 10 in accordance with various embodiments. The illustrated heater cable 10 is shown with each layer subsequently stripped to clearly illustrate its construction in accordance with at least one embodiment. In one approach, the heater cable 10 includes a first bus wire 12 and a second bus wire 14 (though other bus wires may be included). The bus wires 12, 14 may be of any suitable conductive material including copper, aluminum, steel, gold, platinum, silver, and others. The bus wires 12, 14 may be solid conductor wires or may be stranded wire. The bus wires 12, 14 are encapsulated within or in direct electrical contact with a conductive positive temperature coefficient (PTC) core 16. In use, a voltage potential is provided across the bus wires 12, 14 via a power supply or power source (not shown), which voltage potential may be provided by an alternating current (AC) or a direct current (DC). The application of this voltage differential results in a current flow through the PTC core 16 from the first bus wire 12 to the second bus wire 14, or vice versa. This current interacts with the PTC core 16 to generate heat; the amount of the resultant heat that is emitted by the heater cable 10 depends on the resistance characteristics of the PTC material.

The PTC core 16 and the bus wires 12, 14 together act as a heating element within the heater cable 10, as the PTC core 16 has a substantially higher resistance than the conductors of the bus wires 12, 14 (which have negligible resistances). Specifically, in terms of fundamental equations, heat is generated by power dissipation, and power (P) is voltage (V) times current (I), or $P=V\times I$. Voltage (V) is current (I) times resistance (R), or $V=I\times R$. Inserting the second equation into the first equation produces the equation $P=I^2\times R$. When comparing the power dissipated (heat generated) by the PTC core 16 (relatively higher resistance) against the power dissipated by bus wires 12, 14 (negligible resistance), these equations show that nearly all the heat is generated by the PTC core 16.

The PTC material of the PTC core 16 acts to limit the current passed through the PTC core 16 based on the temperature of the PTC material. The PTC material has a positive temperature coefficient, meaning the electrical resistance of the material increases as its temperature increases. As the resistance of the PTC material increases, the current passing through the PTC material decreases and the heat locally generated by the flow of current resultantly decreases. So configured, the heater cable 10 is self-regulating because the resistance of the PTC core 16 varies with temperature. For example, portions of the PTC core 16 will have low resistance (leading to higher current between the bus wires and higher heat generation) where the temperature of the PTC material is low. Conversely, portions of the PTC core 16 will have higher resistance (leading to lower current between the bus wires and lower heat generation) where the temperature is high with respect to PTC behavior. When the PTC core 16 temperature increases, the local heat generation is reduced until the current is limited to a point that it stops dissipating into the PTC material as thermal energy. In this manner, the PTC material and the heater cable 10 have an inherent maximum temperature, and heat is supplied only where needed along the length of the heater cable 10 and across the cross-section of the heater cable 10. By this, the entire cable length and cross-section acts to achieve the designed temperature set-point.

According to various embodiments and application settings, the PTC core 16 may be formed of a polymer filled with electrically conductive materials including, for example, polymer-carbon compounds, carbon black compounds, polyolefins (including but not limited to polyethylene (PE), polypropylene (PP), polymethylpentene (PMP), polybutene (PB), polyolefin elastomers (POE), etc.), fluoropolymers (ECA from DuPont™, Teflon® from DuPont™), perfluoroalkoxy polymers (PFA, MFA), polyethylenetetrafluoroethylene (ETFE), polyethylenechlorotrifluoroethylene (ECTFE), fluorinated ethylene-propylene (FEP), polyvinylidene fluoride (PVDF, homo and copolymer variations), Hyflon® from Solvay™ (e.g., P120X, 130X and 140X), polyvinylfluoride (PVF), polytetrafluoroethylene (PTFE), fluorocarbon or chlorotrifluoroethylenevinylidene fluoride (FKM), perfluorinated elastomer (FFKM)), and their mixtures.

The exemplary heater cable 10 is shown having a monolithic construction of the heating element 18, wherein the bus wires 12, 14 are included within a unitary PTC core 16. The monolithic heating element 18 may be formed by various methods, including, for example, extruding or molding the PTC core 16 about the bus wires 12, 14 during manufacture. Other variations are possible, for example, including a formed PTC core 16 that may partially encapsulate the bus wires 12, 14 or may simply be situated adjacent to each of the bus wires 12, 14 so that the bus wires 12, 14 are in direct electrical contact with, and spaced apart by, the PTC core 16. According to various embodiments, the connecting portion 20 of the PTC core 16 extending between the first and second bus wires 12, 14 may include a necked or tapered profile, which is discussed in greater detail with respect to FIG. 2.

The heater cable 10 may include a polymer jacket 22 that provides dielectric separation from the heating element 18 while allowing conductance of heat away from the heating element 18. For example, the polymer jacket 22 may be made from a thin polymer jacket, or may be formed of rubber, Teflon, or another environmentally resilient material. In one embodiment, the polymer jacket 22 may be extruded or molded about the monolithic heating element 18, while in another embodiment the polymer jacket 22 may be a wrapped jacket wrapped around the monolithic heating element 18. The heater cable 10 may further include a ground plane layer 24. This ground plane layer 24 may be constructed of braided metal (e.g., steel, copper, tin, aluminum, etc.) braided about the polymer jacket 22, or may be composed of wrapped metal (e.g., steel, copper, tin, aluminum, etc.) foil and a drain wire for ampacity. The ground plane layer 24 may provide an earth ground for the heater cable 10, can provide additional strength to the heater cable 10, and can aid in heat transfer away from the polymer jacket 22 and monolithic heating element 18 toward the exterior surface of the heater cable 10.

The heater cable 10 may further include an outer jacket 26 surrounding the ground plane layer 24 or another layer. The outer jacket 26 may be made from a thin polymer jacket, or may be formed of rubber, Teflon, or another environmentally resilient material. In one embodiment, the outer jacket 26 may be an extruded jacket while in another embodiment the outer jacket 26 may be a wrapped jacket wrapped around the heater cable 10. Such a wrapped outer jacket may provide an articulated outer surface which results in increased flexibility for ease of installation, which may better accommodate movement and handling of the heater cable 10 during installation and thereafter. Many variations for the ultimate construction of the heater cable 10 are contemplated, including the use of multiple additional varying metallic layers (e.g., a foil layer) and dielectric layers and/or the omission of one or more of the layers described above. These variations can be numerous and may depend on the particular application setting. Additionally, another extruded or wrapped jacket may be wrapped about the outer jacket 26. In any embodiment, the use of a necked or tapered PTC core 16, as described herein, is utilized to provide the realized benefits discussed herein, and the other components of the heater cable 10 may enhance or control such benefits according to a desired implementation and/or use of the heater cable 10.

Figure 2:
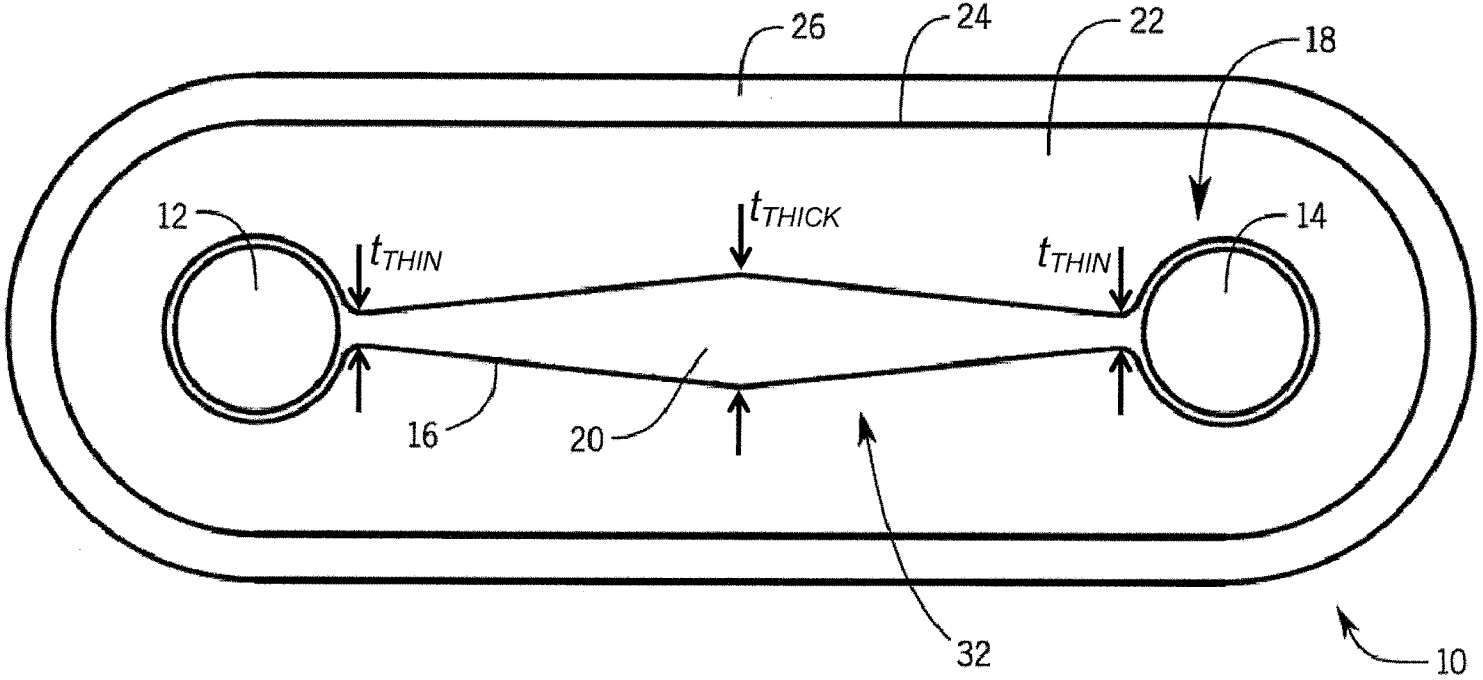
FIG. 2 is a cross-sectional diagram of the heater cable of FIG. 1 in accordance with various embodiments of the present disclosure.

FIG. 2 illustrates a cross-sectional view of the heater cable 10 in accordance with various embodiments. The cross-sectional view shows the first and second bus wires 12, 14 and the PTC core 16, together forming the monolithic heating element 18. Also shown are the polymer jacket 22, the ground plane layer 24, and the outer environmental jacket 26. The connecting portion 20 of the PTC core 16 includes a necked or tapered profile. The necked or tapered profile is such that the cross-sectional thickness of the connecting portion 20 of the PTC core 16 is thicker at, around, or toward the middle of the connecting portion 20 than at the respective ends of the connecting portion 20 approximate the first and second bus wires 12, 14. Accordingly, the cross-sectional thickness can be said to neck or taper towards the ends close to the bus wires 12, 14. The cross-sectional thickness at the thickest part and thinnest part of the connecting portion 20 are illustrated by $t_{THICK}$ and $t_{THIN}$, respectively.

In one embodiment, the shape of the profile of the connecting portion 20 of the PTC core 16 can be defined, at least in part, by a thickness ratio of the thickness of the thickest portion $t_{THICK}$ compared to the thickness of the thinnest portion(s) $t_{THIN}$ (i.e., ratio $t_{THICK}/t_{THIN}$). In at least one embodiment, the thickness ratio is approximately 1.5. In other embodiments, the thickness ratio is 1.3 or higher. Other thickness ratios may be suitable for varying profile shapes, PTC materials, application settings, design requirements, configurations, or other factors.

In one embodiment, as is shown in FIG. 2, the cross-sectional profile is a symmetrical profile having the thickest portion substantially equidistant from (e.g., centered between) each bus wire 12, 14. Both the top surface and the bottom surface of the center portion taper substantially equally toward the bus wires 12, 14 (e.g., at the same angle relative to an imaginary line connecting the centers of each bus wire 12, 14). Also, both the top and bottom surfaces taper in a substantially planar manner, with little to no curve or radius existing at the center ($t_{THICK}$) where the two tapering sides meet, resulting in a point (though this point may include a slight radius). However, many other variations are possible. For example, and with brief reference to FIG. 6, the top and bottom surfaces of a connecting portion 36, 38 may be curved instead of straight, particularly at the center. In such an approach, the "point" at the center of the connecting portion 20 of FIG. 2, where the tapering surfaces meet, may be eliminated and replaced by a hump or convex surface. Other tapering profiles may exist, including, for example, a stepped profile including one or more discrete steps in cross-sectional thickness, or a concave or convex slope (see below) in the PTC core 16 from $t_{THICK}$ to $t_{THIN}$, to create a similar necking effect.

Figure 6:
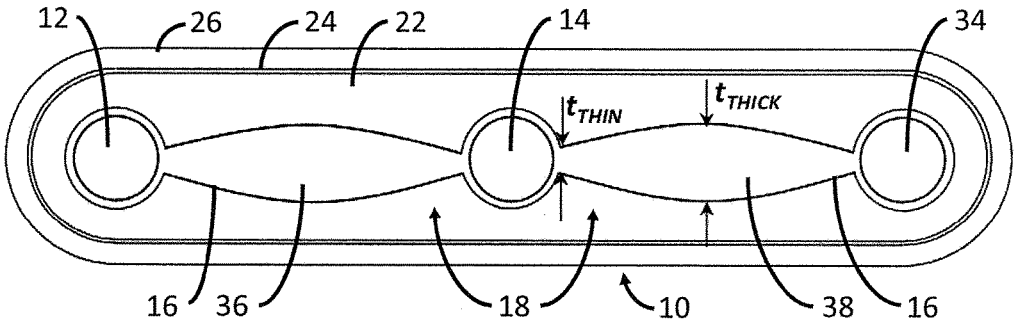
FIG. 6 is a cross-sectional diagram illustrating a variation of the heater cable of FIG. 1 in accordance with various embodiments of the present disclosure.

Referring again to FIG. 2, other cross-sectional profiles are possible for the connecting portion 20 of the PTC core 16. For example, the thickest portion ($t_{THICK}$) may exist at some point other than the center of the connecting portion 20, or at multiple points of the connecting portion 20. The thickest portion may exist for a segment portion of the connecting portion 20, for example, as a plateau. Additionally, such a profile thickness plateau may also exist at one or more locations other than the thickest point. The positioning of the thickest portion relative to the first bus wire 12 and the second bus wire 14 (e.g., left to right) may change dependent upon given application settings, design requirements, or other factors. In other embodiments, the tapering may be non-symmetrical from the center point, or from a thickest portion other than the center point. For example, one side may taper in a linear pattern, while the other side may taper with non-linear pattern (e.g., a logarithmic or exponential pattern), which non-linear tapering may include convex tapering (as is shown in FIG. 6) or concave tapering. In other embodiments, a top surface of the connecting portion 20 may taper with a different profile than the bottom surface. For example, the bottom surface may remain flat while the top surface actively tapers, or the top and bottom surfaces may taper with varying degrees or shapes. As can be readily understood, many tapering profiles are possible for the connecting portion 20 of the PTC core 16, all of which are contemplated by this disclosure.

Previous PTC core designs utilize a flat or planar/linear cross-sectional profile across the connecting portion between bus wires. In such a previous design, the electric field, the ohmic loss, and the temperature can all sharply peak in a small area near the center of the connecting portion of the heater element. This can result in overheating at that small area, thereby increasing the potential for premature failure due to thermal degradation. Additionally, heat provided to the external surface of the heater cable may be more localized toward the center of the cable rather than spread across the surface of the heater cable.

Figure 3:
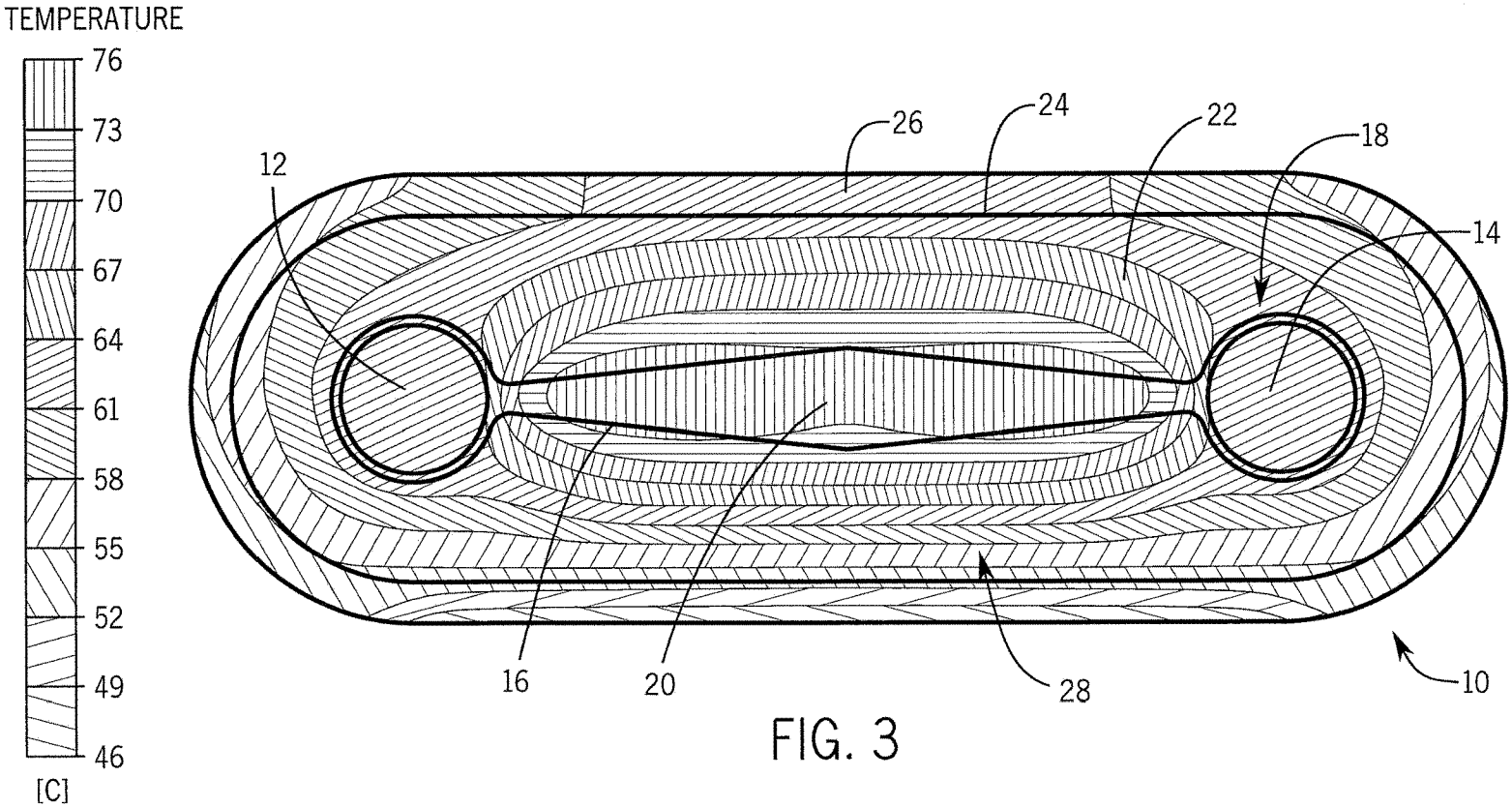
FIG. 3 is a cross-sectional diagram illustrating a thermal gradient of the heater cable of FIG. 1 in accordance with various embodiments of the present disclosure.

The necked or tapered profile of the connecting portion 20 of the PTC core 16 results in an improved cross-sectional thermal profile for the heat generated by the monolithic heating element 18, and for the heater cable 10 as a whole. This serves to maximize thermal equalization by reducing the maximum temperature produced at specific locations within the heating element 18. This can be seen in the thermal profile 28 shown in FIG. 3 in accordance with various embodiments. By utilizing a PTC core profile in accordance with various embodiments of this disclosure, thermal gradients across the connecting portion 20 of the PTC core 16 are reduced. Heat is generated more evenly across the cross-sectional profile as opposed to primarily near the center of the connecting portion 20 as with non-tapering profiles. This in turn allows the overall heater cable 10 to produce heat at its outer surface, for example, the flatter bottom surface in various embodiments, with a more even (i.e., uniform or substantially uniform) heat profile, thereby maximizing the surface area that can actively heat a contacting surface of a structure to be heated (for example, a pipe).

Additionally, because the overall heat generation is spread relatively evenly across nearly the whole connecting portion 20 of the PTC core 16, the maximum temperature at any one location in the PTC core 16 is reduced (as compared to a non-tapering profile) while still providing the same amount, or more of overall heat to the outside surface. In essence, each portion of the cross-sectional length across the connecting portion 20 is generating heat at a fairly equal rate, or at a more equalized rate than with previous designs. This is opposed to a non-tapering profile where a few locations (e.g., the center location) work extra hard to generate heat (e.g., as a hot spot) as compared to the rest of the cross-sectional length in order to still produce the same heat output. The tapered profile spreads the heat generation over a larger volume of PTC material, which reduces the opportunity for such hot spots to form. This may improve the lifespan of the heater cable 10 and reduce the potential for premature failure due to thermal degradation. Further, these effects may improve the unconditional sheath temperature classification of the heater cable 10 as specified by European norm EN60079-30-1.

Figure 4:
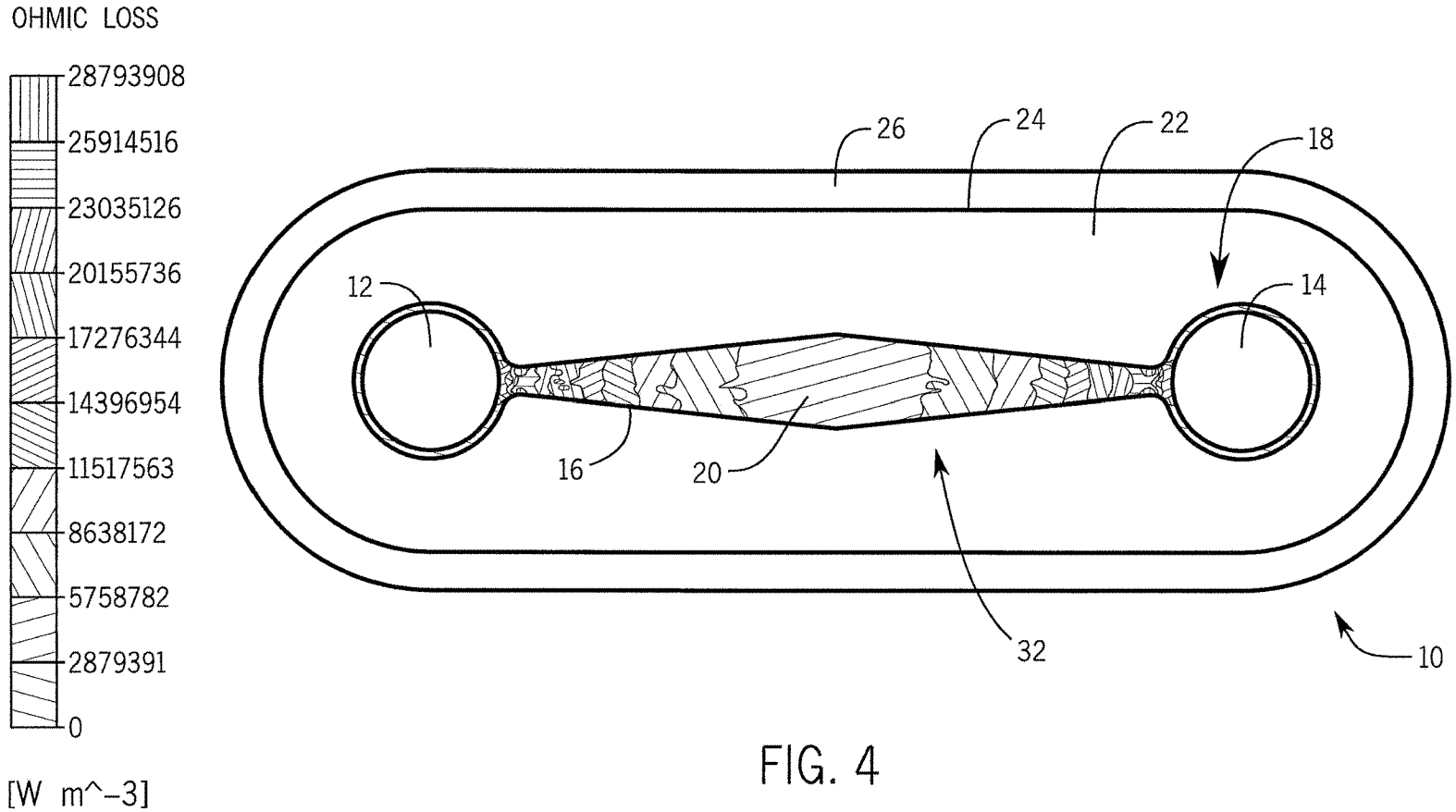
FIG. 4 is a cross-sectional diagram illustrating an ohmic loss of the heater cable of FIG. 1 in accordance with various embodiments of the present disclosure.
Figure 5:
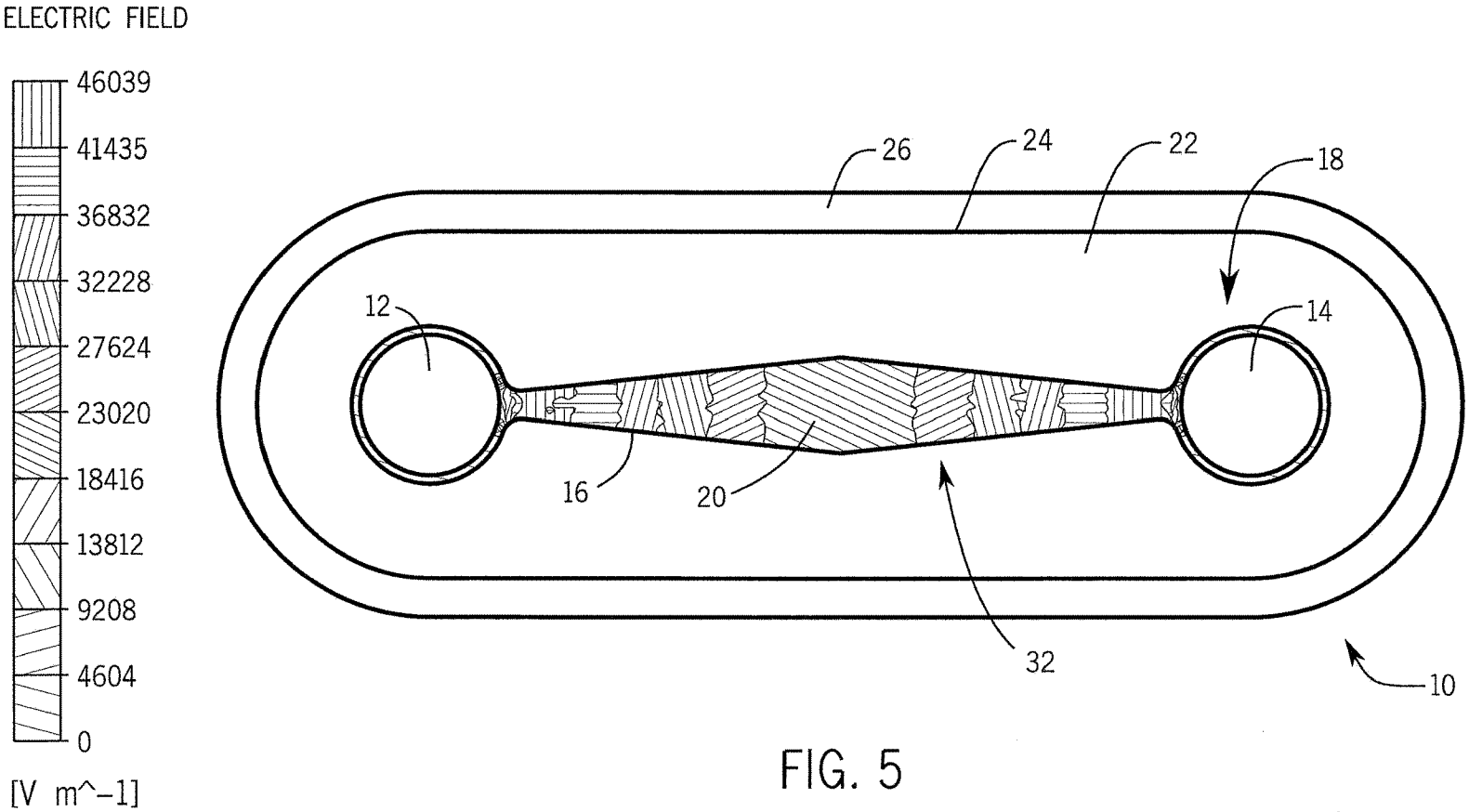
FIG. 5 is a cross-sectional diagram illustrating an electric field of the heater cable of FIG. 1 in accordance with various embodiments of the present disclosure.

Turning now to FIG. 4, a contour plot of the ohmic loss 30 (measured as Watts per cubic meter, or $W/m^3$) across the tapered PTC core 16 is shown in accordance with various embodiments. As is shown, by expanding the thickness near the center of the connecting portion 20 as compared to the ends near the bus wires 12, 14, the ohmic loss near the center of the connecting portion 20, being the thickest portion, is reduced as compared to the ohmic loss at the tapered ends. Similarly, FIG. 5 shows a contour plot of the electric field 32 (measured as Volts per meter, or V/m) across the tapered PTC core. The electric field also is weaker near the center of the connecting portion 20 as compared to the ends near the bus wires 12, 14. Together, the reduced ohmic loss and reduced electric field at the center of the connecting portion 20 result in reduced heat generation at the center, being the primary heat generation location in previous non-tapered designs. Additionally, as the thickness tapers toward the ends, the increased electric field and ohmic loss balances the reduction in thickness to yield a similar amount of heat generation as the center, thereby creating the fairly even thermal profile shown in FIG. 3.

It should be noted that this balance can be upset if, for example, too high of a thickness ratio ($t_{THICK}/t_{THIN}$) is selected. For example, if a much higher thickness ratio is selected, the primary heat generation may be shifted toward the ends near the bus wires, thereby simply shifting the problem hot spot location from the center (in a flat profile) to these ends. In response, the inventors have determined through testing and simulation a suitable range of the ratio. A thickness ratio of approximately 1.5 may be useful in various embodiments. In other embodiments, a thickness ratio of between approximately 1.4 and approximately 1.6 may be useful, and between approximately 1.3 and approximately 1.7 in others. In certain embodiments, a thickness ratio greater than approximately 1.3 may be preferable, while in other embodiments a thickness ration larger than 1.4, 1.5, 1.6, 1.7, 1.8, 1.9, or 2.0, or even as high as 5.0, may be favorable. Certain factors may influence the ideal or useful thickness ratio, including, for example, the type of PTC material used, the shape of the profile, the shape of the heater cable 10, or other design-specific details, application settings, or factors. For example, a length across the connecting portion 20 may be one factor affecting the thickness ratio as such a length may affect the characteristics of the electric field involved. In other examples, material selection for the PTC core 16 may influence characteristic electric field dependence and therefore influence selection or design of the thickness ratio or profile. As can be understood, many combinations of factors may influence the design of the profile, including the thickness ratio and unintentional but expected variations in material dimension caused by manufacture and/or use, and these variations are within the scope of this disclosure.

In various embodiments, more than two bus wires 12, 14 may be provided. For example, and as is shown in FIG. 6, a third bus wire 34 may be provided. The third bus wire 34 may be coupled to a same voltage potential as, for example, the first bus wire 12 or the second bus wire 14, or may be coupled to yet a third voltage potential, which voltage potential may be of alternating current (AC) or direct current (DC) and may be different from either or both of the first and second voltage potentials. In other embodiments, still more bus wires may be provided, for example, a fifth bus wire, a sixth bus wire, a seventh bus wire, and so forth. The spacing and/or configuration of a plurality of bus wires may vary according to particular application settings. For example, the plurality of bus wires may maintain a flat configuration with equal spaces between the bus wires or, alternatively, with varying spacing between the bus wires. In other embodiments, the plurality of bus wires may be helically wrapped or twisted or configured in a triangle shape, a square shape, or other shapes (dependent upon the number of bus wires utilized), wherein the shape is maintained along the length with little to minimum twisting, or with twisting. The number of bus wires and the configurations of bus wires may be driven by particular application settings, design requirements, or other factors.

As is shown in the embodiment illustrated in FIG. 6, a first connecting portion 36 may connect between first bus wire 12 and the second bus wire 14 as described above, and a second connecting portion 38 may be included between the second bus wire 14 and the third bus wire 34. The second connecting portion 38 may be part of the same PTC core 16, or may, in some embodiments, be a separate PTC core from the first PTC core 16. The second connecting portion 38 operates in much the same manner as, if not identical to, the first connecting portion 36 (and, like the connecting portion 20 described above) to generate heat. The second connecting portion 38 may also include a tapered or necked cross-sectional profile that may match the first connecting portion 36. For example, and as is shown in FIG. 6, a necked or tapered profile for the second connecting portion 38 may be such that the cross-sectional thickness of the second connecting portion 38 of the PTC core 16 is thicker at or toward the middle of the second connecting portion 38 (as indicated by $t_{THICK}$) than at the two ends close to the second and third bus wires 14, 34 (as indicated by $t_{THIN}$). In other embodiments, the second connecting portion 38 may have a different tapered or necked cross-sectional profile from the first connecting portion 36, or may even have no taper at all in some approaches. For example, the thickness ratio ($t_{THICK}/t_{THIN}$) of the second connecting portion 38 may be the same or different from the first connecting portion 36. The design and shape of the cross-sectional profile of the second connecting portion 38 may have as many design possibilities and variations as was described with respect to the first connecting portion 20.

In other embodiments still, additional connecting portions may be provided between, for example, the first bus wire 12 and the third bus wire 34, or between any of the bus wires 12, 14, 34 and any other additional bus wires not specifically shown in these figures. One of skill in the art will quickly realize that the teachings described herein may extend to nearly any number of bus wires and many various configurations of the same.

In another embodiment, a method of manufacturing a heater cable 10 includes providing at least two bus wires, for example, the first and second bus wires 12, 14, though more bus wires may be used in various embodiments, including the third bus wire 34. In a next step, the bus wires 12, 14 are encased in a PTC core 16 to form the monolithic heating element 18. In other embodiments, the bus wires 12, 14 are not fully encased within the PTC core 16. In other embodiments still, the PTC core 16 is formed separate from the bus wires 12, 14 and is later joined with the bus wires 12, 14 in a subsequent step. This step may include, in at least one embodiment, passing a moldable form of the PTC material and, optionally, the bus wires 12, 14, through an extruder mold to form the PTC core. In certain embodiments wherein the bus wires 12, 14 are also passed through the extruder, this step also forms the heating element 18. In other embodiments, the heating element 18 is not fully formed until a formed PTC core 16 is mated with two or more bus wires 12, 14.

In certain embodiments, the extruder includes a cross-sectional extrusion molding profile or shape that matches or is otherwise designed to produce the desired tapered or necked cross-sectional profile for the connecting portion 20 of the PTC core 16 in accordance with various embodiments described herein. The extrusion molding profile is therefore intentionally designed to create the desired tapered or necked cross-sectional profile. In similar embodiments, other molding methods may be utilized to achieve the desired necked or tapered cross-sectional profile, including pressure molding, vacuum molding, or other known molding and cable manufacturing methods known in the art. In still other embodiments, the heater element may be formed via an extrusion step, for example having a basic flat or rectangular cross-sectional profile. A desired tapered or necked cross-sectional profile may then subsequently be pressed, molded, cut, scraped, ground, routed, etched, or otherwise formed into the connecting portion 20.

In subsequent steps, the extruded or otherwise molded heating element 18 is passed through another extruder step along with the polymer material to form the polymer jacket 22. Again, other molding methods may be suitable in certain application settings. The ground plane layer 24 is optionally applied thereafter, for example, by directly braiding or weaving the metallic or galvanic conductors onto the polymer jacket 22. In another embodiment, the ground plane layer 24 is pre-braided and the heating element 18 with polymer jacket 22 is passed through the pre-braided ground plane layer 24, which is then stretched or manipulated to cover the polymer jacket 22. In a next step, the outer environmental jacket 26 is applied, for example, via extrusion, wrapping, sintering, or other known methods. It should be understood that other manufacturing steps may be included and/or omitted dependent upon a given application settings. However, the necked or tapered cross-sectional profile of the PTC core 16 should be created in accordance with the teachings described herein and/or modifications of the same, which modifications are within the scope of the present disclosure.

So configured, a heater cable 10 and corresponding method of manufacturing the same are described. In accordance with various embodiments, the heater cable 10 is capable of reducing a temperature gradient across a PTC core during operation, thereby improving a temperature gradient produced on an outside surface of the heater cable 10. Additionally, this improved temperature gradient serves to reduce the maximum temperature generated at any one location within the PTC core, thereby reducing hot spot formation and reducing premature failure due to thermal degradation.

The present invention has been described in terms of one or more preferred embodiments, and it should be appreciated that many equivalents, alternatives, variations, and modifications, aside from those expressly stated (e.g., methods, product by process, and so forth), are possible and within the scope of the invention.

We claim:

1. A self-regulating heater cable comprising:

a heating element including a first bus wire and a second bus wire both encapsulated, in a cross-sectional profile of the heater cable, by a monolithic positive temperature coefficient (PTC) core having a connecting portion that extends between and spaces apart the first and second bus wires, the connecting portion having a first thickness at each of a first end of the connecting portion approximate the first bus wire and a second end of the connecting portion approximate the second bus wire, and the connecting portion further having a second thickness at a center of the connecting portion, the second thickness being greater than the first thickness at a ratio of at least 1.5.

2. The self-regulating heater cable of claim 1, wherein the connecting portion tapers from the center to each of the first end and the second end in a substantially planar manner.

3. The self-regulating heater cable of claim 2, wherein the connecting portion tapers to a point at the center.

4. The self-regulating heater cable of claim 2, wherein a top surface and a bottom surface of the connecting portion both taper from the center to each of the first end and the second end.

5. The self-regulating heater cable of claim 1, wherein a top surface and a bottom surface of the connecting portion both are curved and convex.

6. The self-regulating heater cable of claim 1, wherein the first thickness and the second thickness are selected such that the ratio is below a threshold at which primary heat generation of the self-regulating heater cable shifts from the center of the connecting portion to one or both of the first end and the second end of the connecting portion.

7. A heater cable comprising:

at least two bus wires;

at least one positive temperature coefficient (PTC) core in contact with each of the at least two bus wires, the PTC core including at least one connecting portion extending between the at least two bus wires, the at least one connecting portion having a tapered cross-sectional profile wherein a first portion of the at least one connecting portion has a first thickness that is greater than a second thickness of the at least one connecting portion at one or more ends of the at least one connecting portion, each end approximate one of the at least two bus wires, wherein a ratio of the first thickness to the second thickness is greater that approximately 1.3.

8. The heater cable of claim 7, wherein the ratio is further less than or equal to approximately 5.0.

9. The heater cable of claim 7, wherein a ratio of the first thickness to the second thickness is within a range at which:

the heater cable produces heat at an outer surface of the heater cable with a substantially uniform profile; and primary heat generation of the heater cable has not shifted from the center of the connecting portion to one or more of the ends of the connecting portion.

10. The heater cable of claim 7, wherein the first portion is toward the center of the at least one connecting portion.

11. The heater cable of claim 7, wherein one or both of a top surface and a bottom surface of the at least one connecting portion has a taper that forms the first thickness and the second thickness.

12. The heater cable of claim 11, wherein the taper is planar.

13. The heater cable of claim 7, further comprising a polymer jacket surrounding the at least one PTC core and the at least two bus wires and providing dielectric separation from the at least one PTC core while allowing conductance of heat away from the at least one PTC core.

14. The heater cable of claim 13, further comprising an outer jacket surrounding the polymer jacket, the outer jacket formed from an environmentally resilient material.

15. A method of manufacturing a heater cable, the method comprising:

forming a positive temperature coefficient (PTC) material into electrical contact with at least two bus wires to produce a heating element having a connecting portion of PTC material extending between a first bus wire and a second bus wire of the at least two bus wires; and forming a tapered cross-sectional profile in the connecting portion, wherein the tapered cross-sectional profile produces a first thickness in one or both of a first end and a second end of the connecting portion, and produces a second thickness in a thicker portion of the connecting portion between the first end and the second end, wherein the second thickness is greater than the first thickness, the second thickness and the first thickness being produced at a ratio greater than approximately 1.3.

16. The method of claim 15, wherein forming the tapered cross-sectional profile comprises forming the thicker portion about the center of the connecting portion.

17. The method of claim 15, wherein forming the PTC material into electrical contact with the at least two bus wires comprises passing the at least two bus wires and the PTC material through an extruder mold having a tapered extrusion mold profile designed to create the tapered cross-sectional profile.

* * * * *